US006159675A

United States Patent [19]

Ly et al.

[11] Patent Number: 6,159,675

[45] Date of Patent: Dec. 12, 2000

[54] COLOR PHOTOGRAPHIC SILVER HALIDE MATERIAL

[75] Inventors: Cuong Ly, Köln; Matthias Feigl, Leverkusen; Markus Geiger, Langenfeld, all of Germany

[73] Assignee: Agfa-Gevaert Naamloze Vennootschap, Mortsel, Belgium

[21] Appl. No.: 09/318,040

[22] Filed: May 25, 1999

[30] Foreign Application Priority Data

Jun. 2, 1998 [DE] Germany ..... 198 24 489
Aug. 1, 1998 [DE] Germany ..... 198 34 831

[51] Int. Cl.[7] ..... G03C 1/08; G03C 7/26; G03C 7/32

[52] U.S. Cl. ..... 430/551; 430/555; 430/558; 430/607; 430/611; 430/504; 430/506

[58] Field of Search ..... 430/504, 506, 430/543, 555, 558, 551, 607, 611

[56] References Cited

U.S. PATENT DOCUMENTS

| | | | |
|---|---|---|---|
| 4,957,855 | 9/1990 | MacIntyre et al. | 430/611 |
| 5,051,336 | 9/1991 | Inoue et al. | 430/611 |
| 5,356,759 | 10/1994 | Mitsui et al. | 430/611 |
| 5,374,505 | 12/1994 | Heinecke et al. | 430/504 |
| 5,679,508 | 10/1997 | Mucke et al. | 430/611 |
| 5,919,612 | 7/1999 | Ly et al. | 430/611 |

*Primary Examiner*—Geraldine Letscher
*Attorney, Agent, or Firm*—Connolly, Bove, Lodge & Hutz, LLP

[57] ABSTRACT

A colour photographic material having a support and at least one silver halide emulsion layer containing couplers, which layer contains as couplers a 2-equivalent magenta coupler and both at least one compound of the formula (III) and at least one compound of the formula (IV):

(III)

(IV)

in which $R_4$ to $R_9$ and n have the meaning stated in the description, is distinguished by reduced pressure sensitivity.

13 Claims, No Drawings

COLOR PHOTOGRAPHIC SILVER HALIDE MATERIAL

This invention relates to a colour photographic silver halide material having improved pressure sensitivity.

Colour photographic silver halide materials which contain at least one 2-equivalent coupler as the magenta coupler are distinguished by brilliant colour reproduction and low silver halide application rates. Disadvantageously, however, they are sensitive to pressure. Pressure sensitivity in the moist state in particular makes it virtually impossible to use these couplers. This applies in particular to couplers of the formulae I and II:

(I)

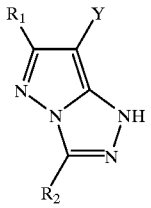

(II)

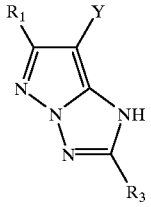

in which $R_1$, $R_2$ and $R_3$ mutually independently mean hydrogen, alkyl, aralkyl, aryl, aroxy, alkylthio, arylthio, amino, anilino, acylamino, cyano, alkoxycarbonyl, alkylcarbamoyl or alkylsulfamoyl, wherein these residues may be further substituted and wherein at least one of these residues contains a ballast group, Y means a residue, other than hydrogen, which is eliminable on chromogenic coupling (fugitive group).

These couplers are per se particularly advantageous by virtue of the brilliance of the magenta dyes produced therewith.

Preferably, in the formulae I and II, $R_1$ means t-butyl and Y means Cl.

The object of the invention was to bring about a decisive reduction in (wet) pressure sensitivity.

This property is tested by swelling exposed specimens of the photographic material in water of hardness 0°DH [=German hardness value] at 23° C. for 30 seconds and subjecting them to a defined force with a sintered ceramic test tool, wherein a force of 1.0N is used for semi-finished products and a force of 1.5N for finished products. The specimens are then processed and visually evaluated.

It has now been found that this object is achieved by the combination of at least one stabiliser of the formula (III) and at least one stabiliser of the formula (IV):

(III)

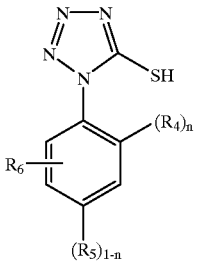

(IV)

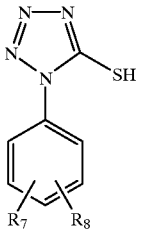

in which $R_4$, $R_5$ mean alkoxy or alkylmercapto, $R_6$ means H, alkyl, halogen or $R_4$, $R_7$ means H, alkyl, halogen, OH or alkoxy, $R_8$ means $NHCOR_9$, $R_9$ means alkyl or aryl and n means0 or 1.

Preferably, n means zero, $R_6$ and $R_7$ mean H, $R_5$ means alkoxy and $R_9$ means alkyl.

Both classes of stabilisers have previously been used individually or in combination with other stabilisers, but without bringing about the desired improvement in pressure sensitivity. In particular, the combination of 1-(3-methoxyphenyl)-5-mercaptotetrazole and 1-(3-acetamidophenyl)-5-mercaptotetrazole known from U.S. Pat. No. 4 957 855 still does not bring about a sufficient reduction in pressure sensitivity.

Only combined use completely surprisingly brought about an improvement without any impairment of the storage stability of the unprocessed material.

The present invention accordingly provides a colour photographic material having a support and at least one silver halide emulsion layer containing couplers, which layer contains as couplers a 2-equivalent magenta coupler and both at least one compound of the formula (III) and at least one compound of the formula (IV).

The colour photographic material is in particular a print material, the support of which may be transparent or light-reflective. Reflective supports, in particular paper coated on both sides with polyethylene, are preferred.

The stabiliser combination according to the invention is in particular used in a quantity of 0.1 to 3.0 g/1000 g of $AgNO_3$ of the emulsion concerned, preferably of 0.3 to 2.0 g/1000 g of $AgNO_3$. The compounds of the formula (III) are preferably present in a weight ratio relative to the compounds of the formula (IV) of 6:1 to 1:6, preferably of 4:1 to 1:4.

The emulsion is preferably ripened with gold and sulfur compounds, in particular in a concentration of $2\cdot10^{-6}$ to $2\cdot10^{-4}$ mol. of gold compound/mol. of Ag and $10^{-6}$ to $10^{-4}$ mol. of sulfur compound/mol. of Ag.

Silver halides which may be considered are AgCl, AgBr and AgBrCl.

Silver chloride/bromide emulsions containing 80 to 99.9 mol. % of AgCl are preferred. Particularly distinct effects are obtained with silver chloride/bromide emulsions having chloride contents of above 95, preferably of above 98 mol. %.

The silver halide emulsion according to the invention is preferably doped with $10^{-9}$ to $10^{-4}$ mol. of $Rh^{3+}$ and/or $10^{-9}$ to $10^{-4}$ mol. of $Ir^{4+}$ ions per mol. of silver halide.

Compounds suitable for doping the silver halide emulsion according to the invention are, for example, $Na_3RhCl_6$ and $Na_2IrCl_6$. Further suitable compounds are described in European patents 336 425, 336 426 and 336 427.

Suitable gold ripening agents are, for example, $H(AuCl_4)$+KSCN, $Na_3[Au(S_2O_3)_2]$. $2H_2O$ and gold rhodanide. Further gold ripening agents are known from German patents 854 883 and 848 910.

Compounds suitable for sulfur ripening are, for example, thiosulfates and thioureas, such as N,N-dimethylthiourea and N-allylthiourea as well as thioacetamide.

In a preferred embodiment, the combination of stabilisers according to the invention is added at any desired point in time after the end of crystal precipitation and before the end of chemical ripening. In one particularly preferred embodiment, addition is made directly after the end of sensitisation.

The silver halide may comprise predominantly compact crystals, which are, for example, regularly cubic or octahedral or they may have transitional shapes. Preferably, however, lamellar crystals may also be present, the average ratio of diameter to thickness of which is preferably less then 12:1, wherein the diameter of a grain is defined as the diameter of a circle the contents of which correspond to the projected surface area of the grain. The layers may, however, also have tabular silver halide crystals, in which the ratio of diameter to thickness is greater than 12:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 $\mu$m and 2.0 $\mu$m, the grain size distribution may be both homodisperse and heterodisperse. The emulsions may, in addition to the silver halide, also contain organic silver salts, for example silver benzotriazolate or silver behenate.

Two or more types of silver halide emulsions which are produced separately may be used as a mixture.

The photographic emulsions may be produced by various methods (for example P. Glafrides, *Chimie et Physique Photographique*, Paul Montel, Paris (1967), G. F. Duffin, *Photographic Emulsion Chemistry,* The Focal Press, London (1966), V. L. Zelikman et al., *Making and Coating Photographic Emulsion*, The Focal Press, London (1966)) from soluble silver salts and soluble halides.

Precipitation of the silver halide preferably proceeds in the presence of the binder, for example gelatine, and may be performed in an acidic, neutral or alkaline pH range, wherein silver halide complexing agents are preferably additionally used. Such agents include, for example, ammonia, thioether, imidazole, ammonium thiocyanate or excess halide. The water-soluble silver salts and the halides are brought together optionally consecutively using the single jet process or simultaneously using the double jet process or by any combination of both processes. Feeding is preferably performed with rising inflow rates, wherein the "critical" feed rate, at which no further new nuclei are formed, should not be exceeded. The pAg range may vary within wide limits during precipitation, the so-called pAg-controlled process is preferably used in which a specific pAg value is held constant or a defined pAg profile is followed during precipitation. In addition to the preferred precipitation with a halide excess, so-called inverse precipitation with a silver ion excess is, however, also possible. Apart from by precipitation, the silver halide crystals may also grow by physical ripening (Ostwald ripening) in the presence of excess halide and/or silver halide complexing agent. Growth of the emulsion grains may even predominantly proceed by Ostwald ripening, wherein preferably a fine grained, so-called Lippmann emulsion is mixed with a more sparingly soluble emulsion and recrystallised thereon.

Salts or complexes of metals, such as Cd, Zn, Pb, Tl, Bi, Hg, Fe, Pt, Pd, Rh, Ir, Ru may also be present during precipitation and/or physical ripening of the silver halide grains.

Precipitation may furthermore proceed in the presence of sensitising dyes. Complexing agents and/or dyes may be inactivated at any desired point in time, for example by changing the pH value or by oxidative treatment.

The silver halide emulsions which are stabilised are preferably green-sensitised and used together with a magenta coupler.

Examples of colour photographic materials are colour photographic films and colour photographic paper, wherein halogen lamps or laser exposure units are used as the light sources for exposure.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these photosensitive layers may be differently arranged. This is demonstrated for the most important products:

Colour photographic materials, in particular display film and paper, have on the support, in the stated sequence, 1 or 2 blue-sensitive, yellow-coupling silver halide emulsion layers, 1 or 2 green-sensitive, magenta-coupling silver halide emulsion layers and 1 or 2 red-sensitive, cyan-coupling silver halide emulsion layers. The layers of identical spectral sensitivity differ with regard to the photographic sensitivity thereof, wherein the less sensitive sub-layers are generally arranged closer to the support than the more highly sensitive sub-layers.

A protective layer is conventionally located between the green-sensitive and blue-sensitive layers in order to increase dye stability or to improve colour reproduction.

Possible options for different layer arrangements and the effects thereof on photographic properties are described in *J. Inf. Rec. Mats.,* 1994, volume 22, pages 183–193.

The number and arrangement of the photosensitive layers may be varied in order to achieve specific results.

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers may be found in *Research Disclosure* 37254, part 3 (1995), page 286 and in *Research Disclosure* 37038, part XV (1995), page 89.

Details relating to colour couplers may be found in *Research Disclosure* 37254, part 4 (1995), page 288 and in *Research Disclosure* 37038, part 11 (1995), page 80. The maximum absorption of the dyes formed from the couplers and the developer oxidation product is preferably within the following ranges: yellow coupler 420 to 490 nm, magenta coupler 500 to 580 nm, cyan coupler 600 to 700 nm.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq..

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

Preferred couplers of the formula 1 are those of the following formula:

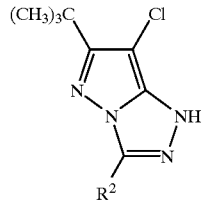

| Coupler | $R_2$ |
|---|---|
| I-1 | $—C_{13}H_{27}$ |
| I-2 | $—(CH_2)_3SO_2C_{12}H_{25}$ |
| I-3 | 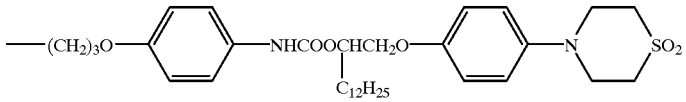 |
| I-4 | 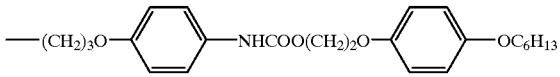 |
| I-5 | 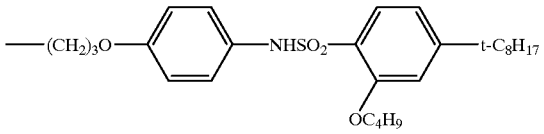 |
| I-6 | 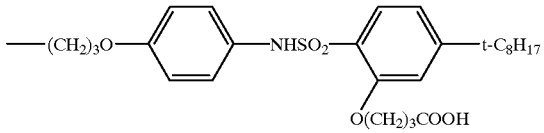 |
| I-7 | $—(CH_2)_2NHCOC_{13}H_{27}$ |

-continued
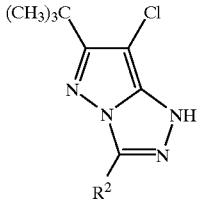
| Coupler | $R_2$ |
|---|---|
| I-8 | 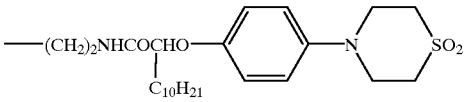 |
| I-9 | 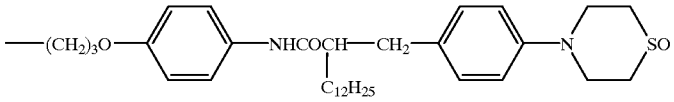 |
| I-10 | 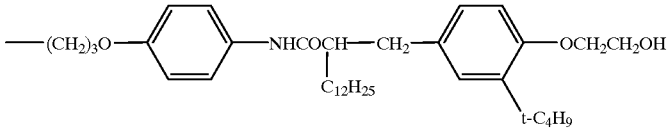 |
| I-11 | 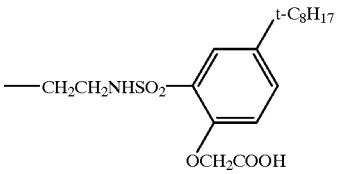 |
| I-12 | $—CH_2CH_2NHSO_2C_{16}H_{33}$ |
| I-13 | $—CH_2CH_2NHCONHC_{12}H_25$ |
| I-14 | $—(CH_2)_3NHSO_2C_{12}H_25$ |
| I-15 | 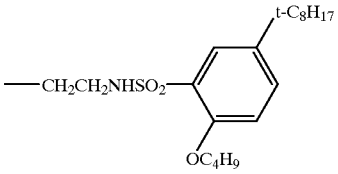 |
| I-16 | 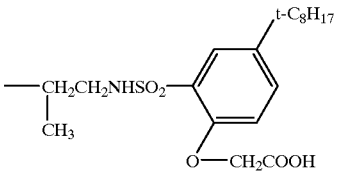 |
| I-17 | 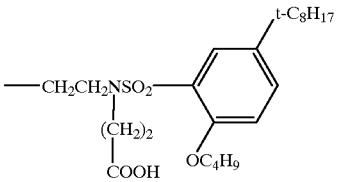 |

-continued
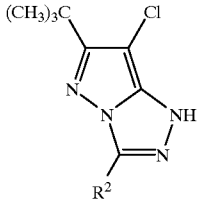
| Coupler | $R_2$ |
|---|---|
| I-18 | 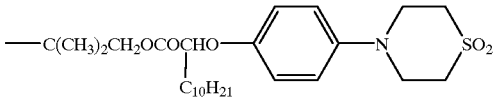 |
| I-19 | 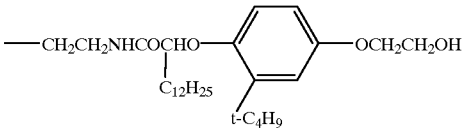 |
| I-20 | 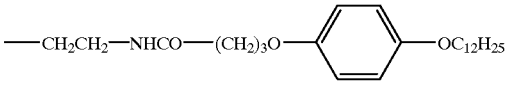 |
| I-21 | $—CH_2CH_2NHCOOC_{12}H_{25}$ |
as well as
I-22
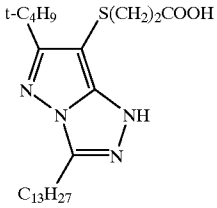
I-23
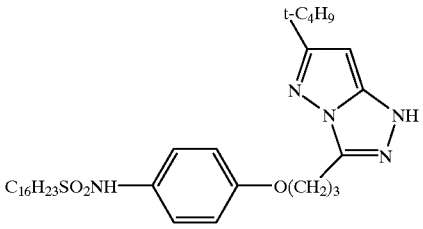
I-24
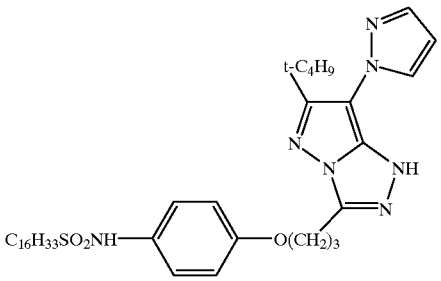

-continued
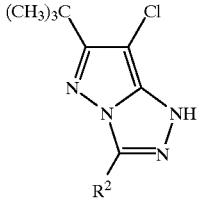
| Coupler | $R_2$ |
|---|---|
| I-25 | 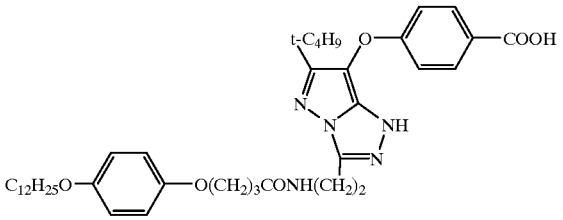 |
Suitable couplers of the formula II are those of the following formula
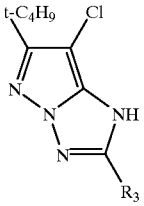
| Coupler | $R_3$ |
|---|---|
| II-1 | 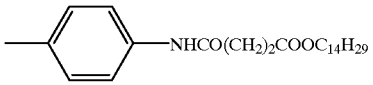 |
| II-2 | 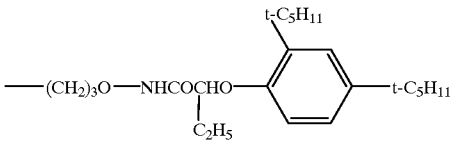 |
| II-3 | 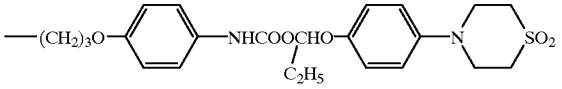 |
| II-4 | 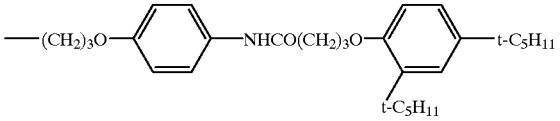 |

-continued
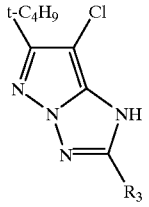
| Coupler | $R_3$ |
|---|---|
| II-5 | 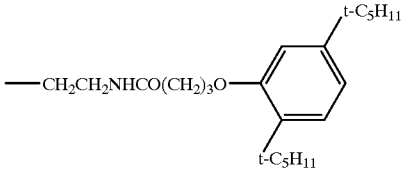 |
| II-6 | 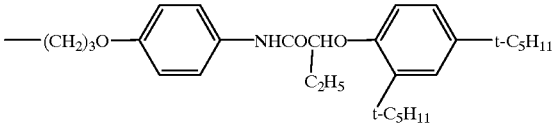 |
| II-7 | 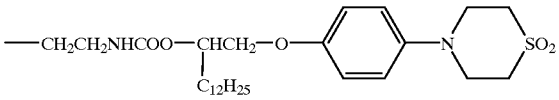 |
| II-8 | 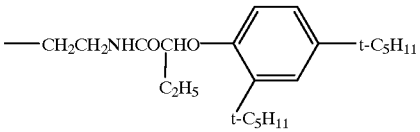 |
| II-9 | $—CH_2CH_2NHCOC_{13}H_{27}$ |
| II-10 | 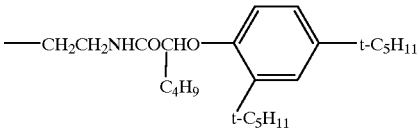 |
| II-11 | $—(CH_2)_3SO_2C_{12}H_{25}$ |
| II-12 | 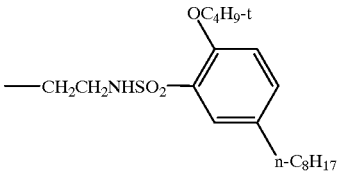 |
| II-13 | 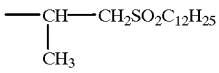 |
| II-14 | 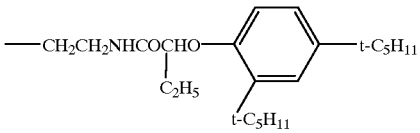 |

-continued
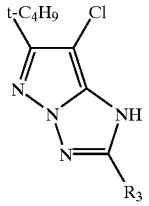
| Coupler | $R_3$ |
|---|---|
| II-15 | 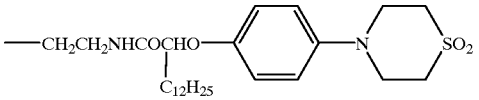 |
| II-16 | 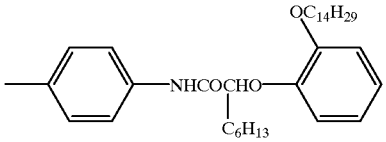 |
| II-17 | 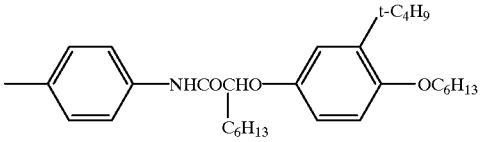 |
as well as
II-18
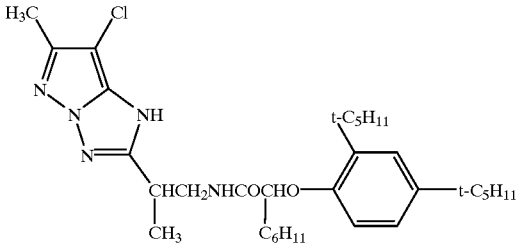
II-19
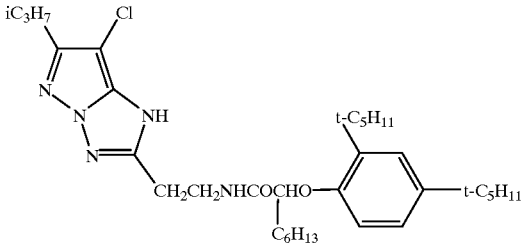
II-20
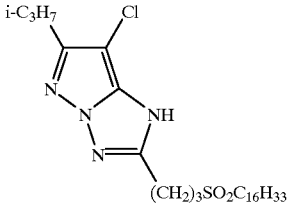

-continued
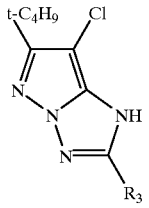
| Coupler | $R_3$ |
|---|---|
| II-21 | 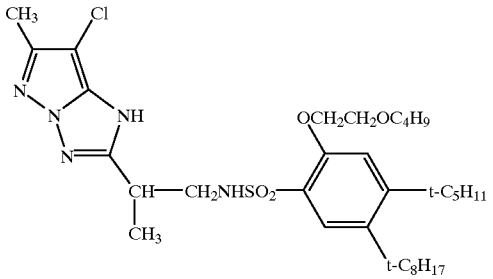 |
| II-22 | 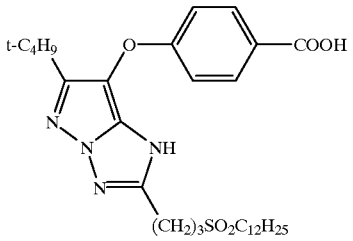 |
| II-23 | 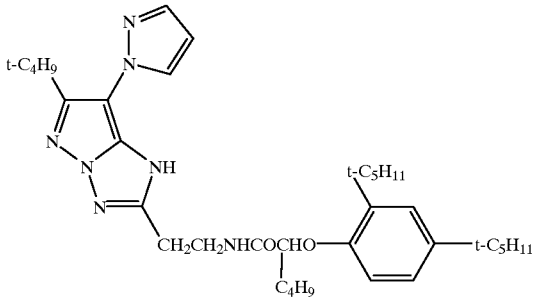 |
| II-24 | 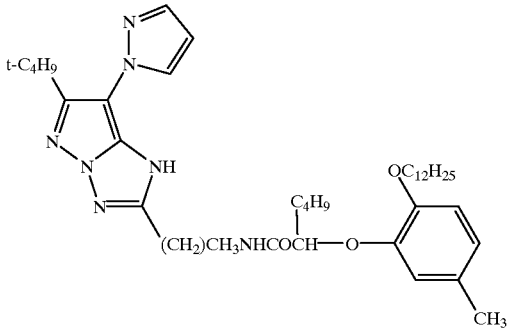 |

Suitable compounds of the formula (III) are:

| Compound | $R_4/R_5$ | $R_6$ |
|---|---|---|
| III-1 | 2-$OCH_3$ | H |
| III-2 | 4-$OCH_3$ | H |
| III-3 | 2-$OCH_3$ | 5-$OCH_3$ |
| III-4 | 4-$OCH(CH_3)_2$ | H |
| III-5 | 4-$OCH_3$ | 2-$CH_3$ |
| III-6 | 2-$OCH_3$ | 4-$CH_3$ |
| III-7 | 4-$OCH_3$ | 3-Cl |

Suitable compounds of the formula (IV) are:

| Compound | $R_8$ | $R_7$ |
|---|---|---|
| IV-1 | 4-$NHCOCH_3$ | H |
| IV-2 | 3-$NHCOCH_3$ | H |
| IV-3 | 4-$NHCOCH_2SCH_3$ | H |
| IV-4 | 3-$NHCOCH_2OCH_3COOH$ | H |
| IV-5 | 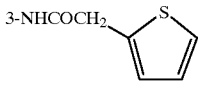 | |
| IV-6 | 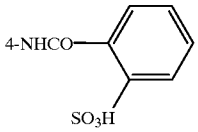 | H |

EXAMPLE 1

Blue-Sensitive Emulsion EmB

The following solutions are prepared with demineralised water:

| | | |
|---|---|---|
| Solution 11: | 1100 g | water |
| | 140 g | gelatine |
| Solution 12: | 1860 g | water |
| | 360 g | NaCl |
| Solution 13: | 1800 g | water |
| | 1000 g | $AgNO_3$ |

Solutions 12 and 13 are added simultaneously at 50° C. over the course of 300 minutes at a pAg of 7.7 with vigorous stirring to solution 11. An AgCl emulsion having an average particle diameter of 0.85 μm is obtained. The gelatine/$AgNO_3$ weight ratio is 0.14. The emulsion is ultrafiltered, washed and redispersed in such a quantity of gelatine that the gelatine/$AgNO_3$ weight ratio is 0.56.

The emulsion is ripened for 2 hours at a pH of 5.3 with an optimum quantity of gold(III) chloride and 5 μmol. of $Na_2S_2O_3$ at a temperature of 50° C. After chemical ripening, the emulsion is spectrally sensitised at 50° C. with 1.4 g of compound (SensB)/kg of $AgNO_3$ and stabilised at 50° C. with 0.5 g/kg of $AgNO_3$ of stabiliser (III-2) and then combined with 0.6 mol. % of KBr (relative to $AgNO_3$).

SensB:

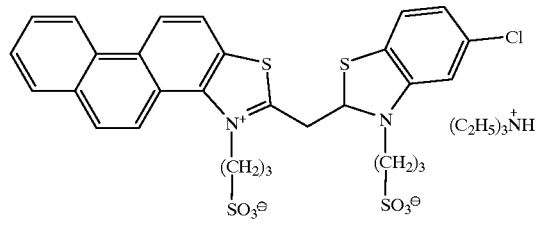

Green-Sensitive Emulsions (EmG 1 to EmG 5)

The following solutions are prepared with demineralised water:

| | | |
|---|---|---|
| Solution 21: | 5000 g | water |
| | 700 g | gelatine |
| Solution 22: | 8250 g | water |
| | 1800 g | NaCl |
| | 2.4 mg | $K_2IrCl_6$ |
| | 0.2 mg | $Na_3RhCl_6$ |
| Solution 23: | 8000 g | water |
| | 5000 g | $AgNO_3$ |

Solutions 22 and 23 are added simultaneously at 60° C. over the course of 105 minutes at a pAg of 7.7 with vigorous stirring to solution 21. A silver chloride emulsion having an average particle diameter of 0.41 μm is obtained. The gelatine/$AgNO_3$ weight ratio is 0.14. The emulsion is ultrafiltered, washed and redispersed in such a quantity of gelatine that the gelatine/$AgNO_3$ weight ratio is 0.56.

The emulsion is ripened for 3 hours at a pH of 5.3 with 14 μmol. of gold(III) chloride/mol. of Ag and 5 μmol. of $Na_2S_2O_3$/mol. of Ag at a temperature of 60° C. After chemical ripening, the emulsion is spectrally sensitised at 50° C. with 1.6 g of compound (SensG)/kg of Ag and divided into 5 portions. Each portion contains silver chloride corresponding to approx. 1 kg of $AgNO_3$.

EmG 1: The first portion is stabilised at 50° C. with 1 g of IV-2 and then combined with 1 mol. % of KBr (relative to $AgNO_3$).

EmG 2: The second portion is stabilised at 50° C. with 0.2 g of III-2 and 0.8 g of IV-2 and then combined with 1 mol. % of KBr (relative to $AgNO_3$).

EmG 3: The third portion is stabilised at 50° C. with 0.5 g of IV-2 and 0.5 g of III-2 and then combined with 1 mol. % of KBr (relative to $AgNO_3$).

EmG 4: The fourth portion is stabilised at 50° C. with 0.2 g of IV-2 and 0.8 g of III-2 and then combined with 1 mol. % of KBr (relative to $AgNO_3$).

EmG 5: The fifth portion is stabilised at 50° C. with 1 g of stabiliser III-2 and then combined with 1 mol. % of KBr (relative to $AgNO_3$).

SensG:

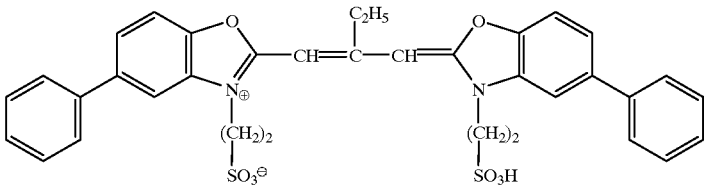

Red-Sensitive Emulsion EmR

The emulsion is produced in the same manner as the green-sensitive emulsions, but, instead of using SensG, the emulsion is spectrally sensitised with 0.25 g of SensR/kg of Ag and then stabilised with 0.6 g of stabiliser IV-2/kg of $AgNO_3$ and 1.2 g of stabiliser EmSt and combined with 0.6 mol. % of KBr (relative to $AgNO_3$).

SensR:

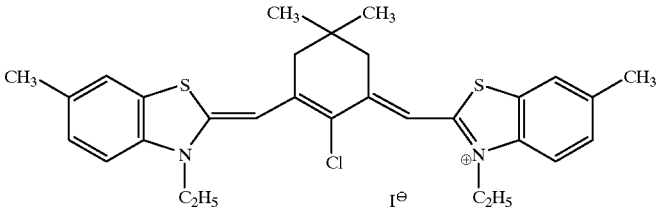

EmSt:

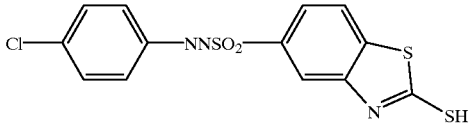

Layer Structures

A colour photographic recording material was produced by applying the following layers in the stated sequence onto a film base of paper coated on both sides with polyethylene. All quantities are stated per 1 $m^2$. The silver halide application rate is stated as the corresponding quantities of $AgNO_3$.

Layer Structure 1

1st layer (Substrate layer):

0.3 g of gelatine

2nd layer (Blue-sensitive layer):

EmB prepared from 0.50 g of $AgNO_3$ 0.635 g of gelatine 0.275 g of yellow coupler Y-1

0.275 g of yellow coupler Y-2

0.38 g of tricresyl phosphate (TCP)

3rd layer (Interlayer):

1.1 g of gelatine 0.08 g of scavenger SC 0.02 g of white coupler WK 0.1 g of TCP 4th layer (Green-sensitive layer):

EmG prepared from 0.23 g of $AgNO_3$ 1.2 g of gelatine 0.23 g of magenta coupler I-1

0.2. g of dye stabiliser ST-1

0.17 g of dye stabiliser ST-2

0.23 g of TCP

5th layer (UV protective layer)

1.1 g of gelatine 0.08 g of SC 0.02 g of WK 0.6 g of UV absorber UV 0.1 g of TCP 6th layer (Red-sensitive layer):

EmR prepared from 0.3 g of $AgNO_3$ with 0.75 g of gelatine 0.36 g of cyan coupler C-1

0.36 g of TCP

7th layer (UV protective layer):

0.35 g of gelatine 0.15g of UV 0.075 g of TCP

8th layer (Protective layer)

0.9 g of gelatine 0.3 g of hardener HM

The following compounds were used:

Y-1
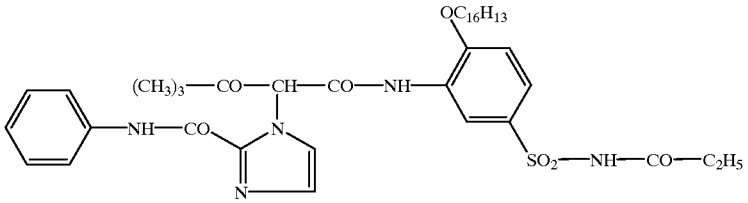
Y-2
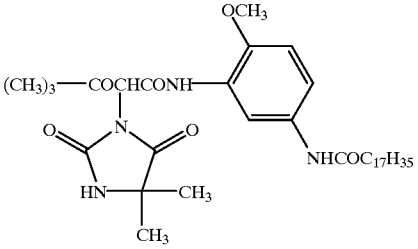
C-1
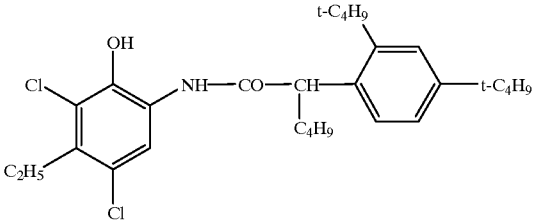
SC
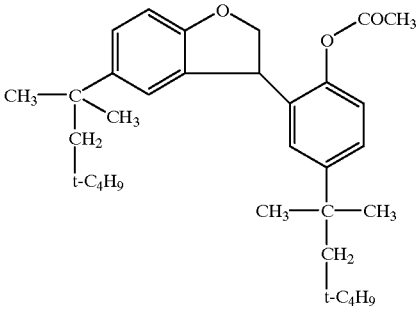
WK
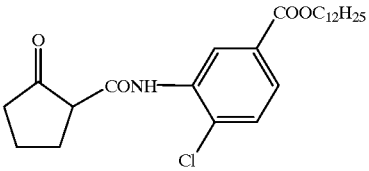
ST-1
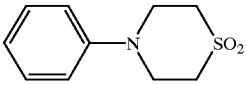

-continued

ST-2

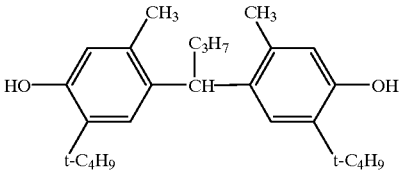

UV

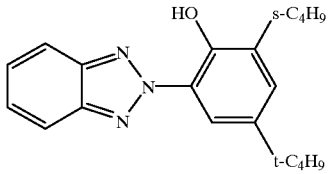

HM

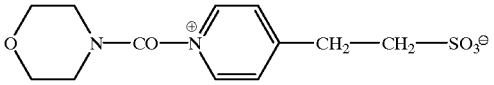

Layers structures 2 to 7 were produced by replacing EmG 1 with another green-sensitive emulsion and magenta coupler I-1 with II-1 and were tested for wet pressure sensitivity.

Testing of Wet Pressure Sensitivity

Test specimens (9 cm×23 cm) with the above-stated variants of the green-sensitive layer were prepared. The test specimens are exposed for an exposure time of 40 ms through a mask wedge with 10 grey levels and subjected to pressure testing. The specimens were swelled in water of hardness 0°DH [=German hardness value] at 23° C. for 30 seconds. A force of 1.5N is applied using a test tool. The test specimens are then processed using an RA-4 process. The traces of the pressure are visually evaluated after processing and the severity of the change in density rated with marks ranging from +5 (=very severe increase in density) through 0 (=no discernible changes) to −5 (=very severe decrease in density). The results are shown in the following table:

| Layer structures | Emulsion | Magenta coupler | Pressure traces | Comments |
|---|---|---|---|---|
| 1 | EmG-1 | I-1 | 5 | Comparison |
| 2 | EmG-2 | I-1 | 2 | Invention |
| 3 | EmG-3 | I-1 | 1 | Invention |
| 4 | EmG-4 | I-1 | −1 | Invention |
| 5 | EmG-5 | I-1 | −4 | Comparison |
| 6 | EmG-1 | II-1 | 4 | Comparison |
| 7 | EmG-3 | II-1 | 1 | Invention |

It is clear that only the stabiliser combination according to the invention gives rise to good resistance to pressure.

We claim:

1. A color photographic material which comprises a support and at least one silver halide emulsion layer containing couplers, which layer contains as couplers a 2-equivalent magenta coupler and both at least one compound of the formula (III) and at least one compound of the formula (IV):

(III)

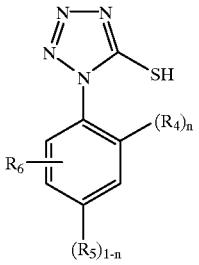

(IV)

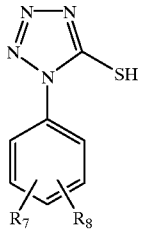

in which $R_4$ and $R_5$ are identical or different and are alkoxy or alkylmercapto, $R_6$ means H, alkyl, halogen or $R_4$, $R_7$ means H, alkyl, halogen, OH or alkoxy, $R_8$ means $NHCOR_9$, $R_9$ means alkyl or aryl and n means 0 or 1.

2. The color photographic silver halide material according to claim 1, wherein the compounds of the formulae (III) and (IV) are used in a total quantity of 0.1 to 3.0 g/1000 of $AgNO_3$ of the emulsion concerned, wherein the weight ratio of formula (III) to formula (IV) is 6:1 to 1:6.

3. The color photographic silver halide material according to claim 1, wherein the silver halide emulsion of at least one silver halide emulsion layer is an AgClBr emulsion containing 80 to 99.9 mol. % of AgCl.

4. The color photographic silver halide material according to claim 3, wherein the AgCl content is above 95 mol. %.

5. The color photographic silver halide material according to claim 1, wherein the silver halide emulsion of at least one silver halide emulsion layer is ripened with gold and sulfur compounds.

6. The color photographic silver halide material according to claim 1, wherein the 2-equivalent magenta coupler is one of the formulae I or II (I)

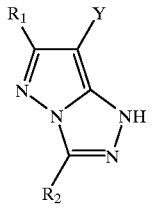

(II)

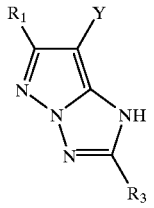

in which $R_1$, $R_2$ and $R_3$ mutually independently mean hydrogen, alkyl, aralklyl, aryl, aroxy, alkylthio, arylthio, amino, anilino, acylamino, cyano, alkoxycarbonyl, alkylcarbamoyl or alkylsulfamoyl, wherein these residues may be further substituted and wherein at least one of these residues contains a ballast group, Y means a residue, other than hydrogen, which is eliminable on chromogenic coupling (fugitive group).

7. The color photographic silver halide material according to claim 6, wherein $R_1$ means t.-butyl and Y means Cl.

8. The color photographic silver halide material according to claim 1, wherein n means zero, $R_6$ and $R_7$ mean H, $R_5$ means alkoxy and $R_9$ means alkyl.

9. The color photographic recording material according to claim 8, wherein the compounds of formulae III and IV are used in a total quantity of 0.03 to 2.0 g/1000 g $AgNO_3$.

10. The color photographic silver halide material according to claim 9, wherein the weight ratio of formula III to formula IV is 4:1 to 1:4.

11. The color photographic silver halide material according to claim 10, wherein the AgCl content is above 98 mol %.

12. The color photographic silver halide material according to claim 1, wherein the silver halide emulsion layer is doped with $10^{-9}$ to $10^{-4}$ mol of $Rh^{3+}$ per mol of silver halide.

13. The color photographic silver halide material according to claim 1, wherein the silver halide emulsion is doped with $10^{-9}$ to $10^{-4}$ ions of $Ir^{4+}$ per mol of silver halide.

* * * * *